US007168833B2

(12) United States Patent
Schottland et al.

(10) Patent No.: US 7,168,833 B2
(45) Date of Patent: Jan. 30, 2007

(54) AUTOMOTIVE HEADLAMPS WITH IMPROVED BEAM CHROMATICITY

(75) Inventors: Philippe Schottland, Evansville, IN (US); Bart Terburg, Mayfield Village, OH (US); David S. Bryce, Nove, MI (US)

(73) Assignee: General Electric Company, Schenectady, NY (US)

( * ) Notice: Subject to any disclaimer, the term of this patent is extended or adjusted under 35 U.S.C. 154(b) by 363 days.

(21) Appl. No.: 10/605,511

(22) Filed: Oct. 3, 2003

(65) Prior Publication Data

US 2004/0095779 A1 May 20, 2004

Related U.S. Application Data

(63) Continuation-in-part of application No. 10/063,791, filed on May 13, 2002, now Pat. No. 6,893,147.

(60) Provisional application No. 60/370,790, filed on Apr. 5, 2002.

(51) Int. Cl.
*F21V 9/16* (2006.01)

(52) U.S. Cl. ..... 362/510; 362/84; 362/293

(58) Field of Classification Search ..... 362/509, 362/510, 260, 84, 307, 311, 335, 293; 428/31; 524/93, 107

See application file for complete search history.

(56) References Cited

U.S. PATENT DOCUMENTS 4,716,501 A 12/1987 McKee et al.
4,968,916 A 11/1990 Davenport et al.
5,059,865 A 10/1991 Bergman
5,548,491 A 8/1996 Karpen
5,605,761 A * 2/1997 Burns et al. ..... 428/412
5,920,429 A * 7/1999 Burns et al. ..... 359/515
5,961,208 A 10/1999 Karpen
6,155,694 A * 12/2000 Lyons et al. ..... 362/228
6,637,922 B2 * 10/2003 Lee ..... 362/544

OTHER PUBLICATIONS

SAE, "Surface Vehicle Recommended Practice, (R) Performance Requirements for Motor Vehicle Headlamps", SAE J1383, iss. Apr. 1985, rev. Dec. 1996, pp. 1-111.

Van Derlofske & Bullough, "Spectral Effects of High-Intensity Discharge Automotive Forward Lighting on Visual Performance", SAE International, 2003-01-0559, pp. 83-90.

(Continued)

*Primary Examiner*—John Anthony Ward
(74) *Attorney, Agent, or Firm*—Marina Larson & Associates, LLC

(57) ABSTRACT

Lenses for lamps can improve the quality of the light emitted through lens by interacting with the light bulb. Photoluminescent dyes as well as non-photoluminescent dyes may be incorporated into a polycarbonate lens in order to shift the chromaticity of the light source. Further, design features such as grooves or protrusions may be incorporated into the lens to allow light produced by the photoluminescent material to escape the lens and be added to the emitted beam to further shift the chromaticity. The emitted beam is of a legal color and intensity as defined per the SAE J578 and SAE J1383 standards. The lighting performance may also be improved in such manner as reducing discomfort glare, increasing brightness or producing a beam that enhances road visibility at night to the human eye.

44 Claims, 3 Drawing Sheets

OTHER PUBLICATIONS

Van Derlofske & Bullough, "Visual Benefits of Blue Coated Lamps for Automotive Forward Lighting", SAE International, 2003-01-0930, pp. 117-124.

Bullough, Van Derlofske, Fay, and DEE, "Discomfort Glare from Headlamps: Interactions Among Spectrum, Control of Gaze and . . . ", SAE International, 2003-01-0296, pp. 21-25.

Sivak, Flannagan, Schoettle and Adachi, "Driving with HID Headlamps: A Review of Research Findings", SAE International, 2003-01-0295, pp. 15-20.

Tiesler-Wittig, Haacke, Jalink and Postma, "Mercury Free Xenon HID—A Challenging Development in a Global Context", SAE International, 2003-01-0558, pp. 77-82.

Tessnow, Reiners and Herning, "Optical Near Field Measurements and Ray-Tracing Simulations of Coated and . . . ", SAE International, 2003-01-0929, pp. 111-115.

Bryce, Shcottland, Vicory, and Terburg, "Lens Material Development for Improved Halogen Headlamp Visibility", SAE International, 2003-01-0991, pp. 153-160.

Ground Vehicle Lighting Standards Manual, SAE International, 2003 Edition, HS-34, (R)Color Specification-SAE J578, Jul. 2002, pp. 180-181.

Terburg and Schottland, "Lens Material Development for Improved Halogen Headlamp Performance and Brand . . . ", Progress in Automobile Lighting (PAL), 2003, 1078-1093.

Van Derlofske, Bullough, and Hunter, "Visual Benefits of High-Intensity Discharge Automotive Forward Lighting", SAE International, 2002-01-0259, pp. 51-56.

Bullough, Fu and Van Derlofske, "Discomfort and Disability Glare from Halogen and HID Headlamp Systems", SAE International, 2002-01-0010, pp. 1-5.

Callahan and Lapatovich, "On the Removal of Mercury from Automotive HID Lamps: A Technical and Regulatory Perspective", SAE International, 2002-01-0976, pp. 201-207.

Bullough and Rea, "Driving in Snow: Effect of Headlamp Color at Mesopic and Photopic Light Levels", SAE International, 2001-01-0320, pp. 67-75.

Van Derlofske, Bullough and Hunter, "Evaluation of High-intensity Discharge Automotive Forward Lighting", SAE International, 2001-01-0298, pp. 1-7.

Rosenhahn and Hamm, "Measurements and Ratings of HID Headlamp Impact on Traffic Safety Aspects", SAE International, 2001-01-0302, pp. 29-35.

Karpen, "Neodymium Oxide Doped Headlight Lamps", SAE International, 2001-01-0319, pp. 59-65.

ECE Regulation 99, "Uniform Provisions Concerning the Approval of Gas-Discharge Light Sources for Use in Approved Gas-Discharge Lamp . . . " United Nations, Aug. 10, 2001.

* cited by examiner

AUTOMOTIVE HEADLAMPS WITH IMPROVED BEAM CHROMATICITY

CROSS REFERENCE TO RELATED APPLICATIONS

This application is a continuation in part of U.S. patent application Ser. No. 10/063,791 filed May 13, 2002 now U.S. Pat. No. 6,893,147, which claims the benefit of U.S. Provisional Application Ser. No. 60/370,790 filed Apr. 5, 2002. Both applications are incorporated herein by reference.

BACKGROUND OF INVENTION

This application relates to lenses which may be used in lamps, particularly automotive headlamps, which provide a shift in chromaticity of the light source beam.

Automotive headlamps are highly controlled products that must meet the SAE performance standard (SAE J1383) to be commercialized. To be compliant, the combination bulb (i.e. the light source)/lens must emit a "white" color and provide enough light output (usually characterized by the total luminous flux "isocandela" and "maximum candela" point intensity testing) in a homogeneous manner. Specifications have been defined around the white beam color as presented in the SAE J578 standard. The white beam color is defined as a small portion of the color space in the CIE 1931 chromaticity diagram. The allowed portion of the color space if defined by blue, yellow, green, purple, and red boundaries that stem from the CIE 1931 x and y color coordinates. Commercially available headlamps use different types of bulbs but usually a "natural" colored lens or slightly tinted lens. In general, these lenses have a clear appearance but could display a very subtle blue or yellow tint. The most common bulb on the market is a halogen bulb. In the past few years, high performance bulbs have been introduced. These new bulbs usually referred to as HID ("High Intensity Discharge") are in fact Xenon lamps. It is well known to those skilled in the art that the power spectral distribution of a Xenon bulb is different from a halogen bulb. For example, a Xenon bulb will emit more energy at lower wavelengths and especially in the 300 to 500 nm range that corresponds to the long UV up to violet/blue-green. As a result, the light emitted from the HID is bluer compared to a halogen bulb which will consequently appear more yellow. When mounted in a headlamp, the beam emitted from a HID/"natural" lens combination will appear whiter. A whiter beam is commonly acknowledged as more efficient since it enhances the road visibility at night. However, there are two major disadvantages to the use of HID bulbs in headlamps. Firstly, these high performance bulbs are extremely expensive compared to halogen bulbs. As a result, headlamps based on HID bulbs are a limited market, often offered as an option on vehicles for an extra-cost in the range of $300 to $800 per unit. Secondly, recent studies have shown that these headlamps have a tendency to cause more discomfort glare for oncoming drivers.

Automotive headlamp lenses are usually made of natural color or slightly tinted polycarbonate as a main material. The primary reasons behind the use of polycarbonate are its relatively high glass transition temperature, impact resistance and excellent clarity/light transmission in the visible range. Lexan® LS-2 polycarbonate is one of the leading materials currently in use for automotive lenses; including headlamp lenses, bezels and taillight lenses. Other high glass transition temperature materials are also being used including copolymers but their natural color or light transmission sometimes renders the emitted headlamp beam of a lesser quality. It is well known to those skilled in the art of coloring automotive lenses that the natural or slightly tinted polycarbonate lenses are obtained by addition of a small amount of organic colorants (i.e. dyes or pigments). For example, a blue dye is added to a yellow formulation to neutralize the color (i.e. make the polycarbonate more colorless or "natural"). The main downside of coloring is the decrease in light transmission that results from the absorption of the colorants even when they are present in the polymer matrix at a ppm loading or below. Consequently, the great majority of the lenses that are mounted in headlamps are "natural" or barely tinted.

SUMMARY OF INVENTION

The present invention provides an automotive headlamp comprising a housing for receiving a light source, a light source, an outer lens affixed to the housing and disposed such that light from the light source received in the housing passes through the lens. The lens of the headlamp comprises a polycarbonate and a photoluminescent material. The combination of the lens material and the light source of the present invention provides a shift in the beam chromaticity to a more appealing illuminating headlight beam wherein the light source and the material of the lens are selected such that light emitted from the light source is modified in chromaticity as it passes through the lens such that the illuminating light output from the headlamp has an average x chromaticity coordinate of 0.345 to 0.405. The emitted beam is of a legal color and intensity as defined per the SAE J578 (color/chromaticity) and SAE J1383 (intensity distribution) standards. The lighting performance may also be improved in such manner as reducing glare, increasing brightness or producing a beam that enhances road visibility at night to the human eye.

It is yet another aspect of the present invention to provide a lens a molded body having a generally concave outer surface, a generally flat or convex inner surface and an edge surface. The molded body of the lens is formed from a composition comprising polycarbonate and a photoluminescent material. White light from a light source is transmitted through the lens and results in emission from the photoluminescent material. The emission from the photoluminescent material is then directed out of the lens through grooves or protrusions formed on the inner surface.

Further, It is another aspect of the present invention to provide a method for altering the chromaticity of an automotive headlamp. The method includes the steps of selecting a partial headlamp assembly comprising a light source and a housing, wherein the light source has a first chromaticity. Next, one would select a lens comprising a polycarbonate, fluorescent dye and possibly non-fluorescent dye. Lastly one would affix this lens to the partial headlamp assembly such that light emitted from the light source passes through the lens to form an illuminating headlamp output, wherein the composition of the lens is selected to modify the first chromaticity such that the illuminating headlamp output has a second chromaticity that is different from the first chromaticity, and the second chromaticity has an average× chromaticity coordinate of 0.345 to 0.405.

DETAILED DESCRIPTION

Figure 1:
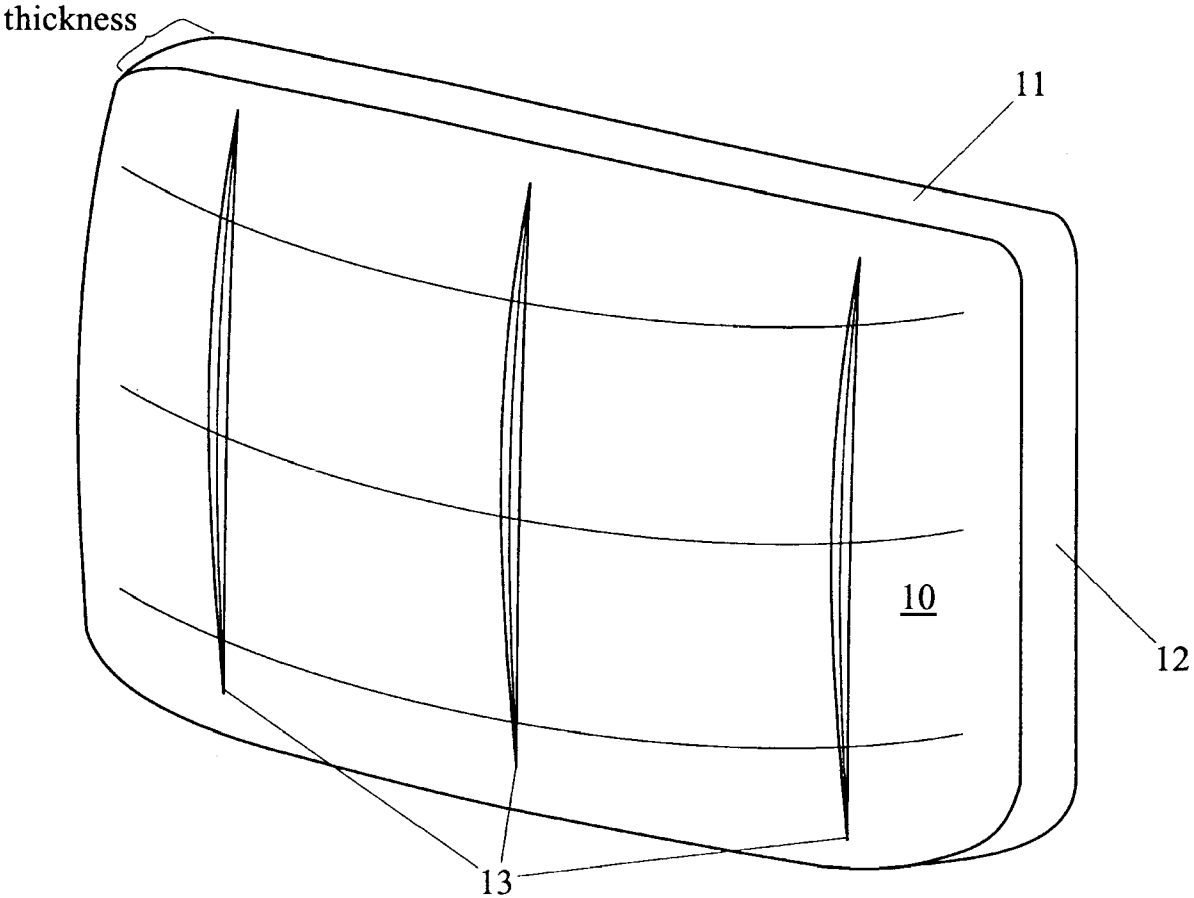
FIG. 1 shows a lamp lens used on automotive headlamps.

The present invention provides an automotive headlamp comprising a housing for receiving a light source, a light source, an outer lens affixed to the housing and disposed such that light from the light source received in the housing passes through the lens. The lens of the headlamp comprises a polycarbonate and a photoluminescent material. The combination of the lens material and the light source of the present invention provides a shift in the beam chromaticity to a more appealing illuminating headlight beam wherein the light source and the material of the lens are selected such that light emitted from the light source is modified in chromaticity as it passes through the lens such that the illuminating light output from the headlamp has an average x chromaticity coordinate of 0.345 to 0.405. The emitted beam is of a legal color and intensity as defined per the SAE J578 (color/chromaticity) and SAE J1383 (intensity distribution) standards. The lighting performance may also be improved in such manner as reducing glare, increasing brightness or producing a beam that enhances road visibility at night to the human eye.

The lens comprises a molded body having a generally concave outer surface, a flat or convex inner surface and an edge surface, wherein the molded body is formed from a composition comprising polycarbonate and a photoluminescent material. Light which includes light of a wavelength within the excitation spectrum of the photoluminscent material is partially absorbed and partially transmitted. The absorbed light is at least partially (depending on the quantum yield of the luminescence) emitted as light of a higher wavelength (as a result of a Stokes shift) and is conducted to a substantial extent to the edge surface of the lens and can thereby create a colored visual effect at the edge of the lens. As used in the specification and claims of this application, the term "substantial extent" means in an amount effective to create an observable visual effect. Generally at least 10% of the light emitted by photoluminescence is conducted through the interior of the lens to the edges, preferably at least 30%. This is achieved in polycarbonate lenses and bezels because the high index of refraction results in significant amount of internal reflection.

Lenses for an automotive headlamps must meet various standards. The lenses of the present invention emit light from an automotive headlamp which is of a legal color and intensity as defined per the SAE J578 (color/chromaticity) and SAE J1383 (intensity distribution) standard. The lighting performance may also be improved in such manner as reducing glare, increasing brightness or producing a beam that enhances road visibility at night to the human eye. Headlamps manufactured using this invention can produce for instance a lower cost alternative to the expensive High Intensity Discharge (HID) lamps in terms of lighting performance while providing more comfort for the driver but also for the cars on the other side of the road because the blinding glare effect of HID lamps is not observed. In addition to the lighting performance, the headlamps may also display a different aesthetic look by creating accent features in the outer lens thus allowing for product differentiation. These features are obtained by creating a synergy between the outer lens and the bulb. The lenses of the present invention are formed from a polycarbonate and one or more photoluminescent materials. As used in the specification and claims of this application, the term "photoluminescent material" refers to any substance that exhibits photoluminescence in response to excitation energy provided by ambient light (sunlight, room light and other artificial light sources), including without limitation organic compounds that solubilize in the plastic polymer matrix during the compounding operation, organic nanoparticle dyes (also known as "nano-colorants") and inorganic photoluminescent materials, including nanoparticles. Photoluminescence occurs when a substance absorbs radiation of a certain wavelength and re-emits photons, generally of a different and longer wavelength. When a photoluminescent molecule absorbs light, electrons are excited to a higher "excited" energy state. The molecule then loses part of its excess of energy by collisions and internal energy conversions and falls to the lowest vibrational level of the excited state. From this level, the molecule can return to any of the vibrational levels of the ground state, emitting its energy in the form of photoluminescence. Photoluminescence is a generic term which encompasses both fluorescence and phosphorescence. In the present invention, the photoluminescent materials are preferably organic fluorescent dyes because of the higher quantum yield associated with fluorescence as opposed to other types of photoluminescent processes. Preferably, the organic fluorescent dye is selected to have a quantum yield of fluorescence of at least 0.7, more preferably at least 0.8 and most preferably at least 0.9 Typically, the emission by fluorescence is an extremely brief phenomenon lasting generally between $10^{-4}$ and $10^{-9}$ seconds.

Specific non-limiting examples of fluorescent dyes that may be used in the articles of the invention are perylene derivatives, anthracene derivatives, indigoid and thioindigoid derivatives, imidazole derivatives, naphtalimide derivatives, xanthenes, thioxanthenes, coumarins, rhodamines, or (2,5-bis[5-tert-butyl-2-benzoxazolyl] thiophene) and all their derivatives and combinations thereof. In general, very low loadings of dyes, for example less than 1.0% are used to create the effect described in this invention. In certain cases, it may be desired to have a final object with the effect of this invention but with almost no visible color (for example a "clear" water bottle). In these cases, the fluorescent dye loading can be extremely low, sometimes as low as 0.0001%. Except for the blue/violet colors and maybe some greens, the fluorescent dye loading to retain the "clear" appearance is usually lower than 0.0005% by weight, for example from 0.0001% to 0.0003% by weight, which is enough to generate a very noticeable visual effect at the edges of the article. In the blue/violet colors, the fluorescent dye loading is significantly higher due to the fact that most of its absorption is located in the UV range. Typically, the fluorescent dye loading in this case is between 0.005% to 0.5% by weight, with 0.01% to 0.2% being preferred and 0.03% to 0.1% being most preferred. Nano-colorants can be obtained by various methods and usually combine the advantages of both dyes and pigments. Their light fastness compared to the corresponding dye molecule is usually greatly improved. Since their particle size is in general less than 100 nanometers, preferably less than 50 nm, and more preferably less than 10 nm, they do not scatter light conversely to most pigments used to color plastics.

Nano-colorants can be obtained by various methods. For example, dye molecules can be converted to nano-colorants by adsorption on a nano-clay particle (with or without creating a chemical bond between the nano-clay and the dye) or by nano-encapsulation in a polymer matrix (usually acrylic polymer). Note that the encapsulation method usually involves emulsion polymerization in order to form spherical nano-particles of polymer in which the dye is dispersed. Nano-colorants can be fluorescent if the dye molecule (or the inorganic compound) used to prepare the nano-colorant is fluorescent. Specific non-limiting examples of fluorescent dyes that may be employed to form nano-colorants used in the articles of the invention are perylene derivatives, anthracene derivatives, indigoid and thioindigoid derivatives, imidazole derivatives, naphtalimide derivatives, xanthenes, thioxanthenes, coumarins, rhodamines, or (2,5-bis[5-tert-butyl-2-benzoxazolyl]-thiophene) and all their derivatives. Inorganic nano-particles may also be used as nano-colorants although their extinction coefficient is usually fairly low. Examples of fluorescent inorganic nano-particles include, but are not limited to, lanthanide complexes and chelates (for instance Europium chelates). Note that some of these inorganic nano-colorant may exhibit a larger Stokes shift than organic fluorescent colorant, i.e. emit light at a much longer wavelength than the excitation wavelength.

The fluorescent dye(s) used in the formulation of the lenses of the invention can be combined with non-fluorescent dyes in order to change the chromaticity of the edge color under daylight illumination or when the bulb is on (night time). Non-fluorescent dyes may be selected from but are not limited to the following families: azo dyes, methine dyes, pyrazolones, quinophtalones, perinones, anthraquinones, phtalocyanines and all their derivatives. The selection of the dye should maximize the synergy between the bulb used and the lens. In other words, the light emitted by the bulb (e.g. a halogen bulb) must be transformed by the lens in such a way that the desired color of visual effect is obtained with the maximum strength while the beam color complies with the SAE requirements (white color beam). By creating a synergy between the bulb and the dyes in the lens, the beam intensity expressed by the candela requirements and the total luminous flux in the headlamp can be controlled. In addition, it is also possible to customize the beam color within the allowed design space defined by the SAE in the CIE 1931 chromaticity diagram. For instance, a blue lens/halogen bulb combination can exhibit a cleaner (or "whiter") beam compared to a "natural" lens. The human eye perceives this difference as a better lighting performance. It must be noted that this "whiter" illumination is a key feature of Xenon bulbs (i.e. HID lamps) but these lamps are known for the discomfort glare experienced by the drivers coming on the other side of the road. The blue lens/halogen bulb combination not only exhibits a very noticeable blue visual effect but also provides a beam of a "whiter" color that constitutes a lighting performance improvement compared to "natural" color lens/halogen bulb combination. Note that the whiter beam generated with the halogen bulb does not create the same glare effect that is observed with HID lamps. The final outer lens/bulb combination is designed to provide a beam color inside the following boundaries defined by the CIE 1931 chromaticity coordinates and preferably measured using spectrophotometric methods as presented in the ASTM standard E308-66:

x=0.31 (blue boundary)

x=0.50 (yellow boundary)

y=0.15+0.64x (green boundary)

y=0.05+0.75x (purple boundary)

y=0.44 (green boundary)

y=0.38 (red boundary)

The dyes used in the lens composition suitably have a heat stability over 300° C., with 320° C. preferred and 350° C. even more preferred for automotive applications. Lower or higher temperatures may be required in other applications depending on the heating characteristics of the lamp employed with the lens. It is important to use organic dyes rather than pigments and especially rather than inorganic pigments. The reason is that pigments have a tendency to scatter light and thus increase haze in the molded lens. Pigments that either fully solubilize in the polycarbonate composition or disperse in particles that do not significantly scatter light may be acceptable at a very low loading.

The polycarbonate component of the lenses of the invention includes compositions having structural units of the formula (I) and a degree of polymerization of at least 4:

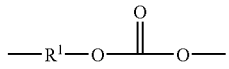

(I)

in which $R^1$ is an aromatic organic radical. Polycarbonates suitable for this invention can be produced by various methods including interfacial, melt, activated carbonate melt, and solid state processes. For example, polycarbonate can be produced by the interfacial reaction of dihydroxy compounds. Preferably, $R^1$ is an aromatic organic radical and, more preferably, a radical of the formula (II):

$$—A^1—Y^1—A^2— \quad (II)$$

wherein each of $A^1$ and $A^2$ is a monocyclic divalent aryl radical and $y^1$ is a bridging radical having zero, one, or two atoms which separate $A^1$ from $A^2$. In an exemplary embodiment, one atom separates $A^1$ from $A^2$. Illustrative, non-limiting examples of radicals of this type are —O—, —S—, —S(O)—, —S($O_2$)—, —C(O)—, methylene, cyclohexylmethylene, 2ethylidene, isopropylidene, neopentylidene, cyclohexylidene, cyclopentadecylidene, cyclododecylidene, adamantylidene, and the like. In another embodiment, zero atoms separate $A^1$ from $A^2$, with an illustrative example being biphenol (OH-benzene-benzene-OH). The bridging radical $y^1$ can be a hydrocarbon group or a saturated hydrocarbon group such as methylene, cyclohexylidene or isopropylidene.

Polycarbonates can be produced by the reaction of dihydroxy compounds in which only one atom separates $A^1$ and $A^2$. As used herein, the term "dihydroxy compound" includes, for example, bisphenol compounds having general formula (III) as follows:

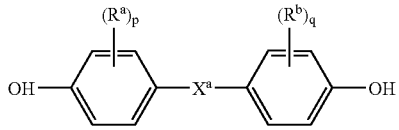

(III)

wherein $R^a$ and $R^b$ each independently represent hydrogen, a halogen atom, or a monovalent hydrocarbon group; p and q are each independently integers from 0 to 4; and $X^a$ represents one of the groups of formula (IV):

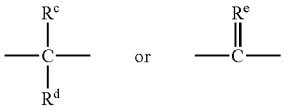

(IV)

wherein $R^c$ and $R^d$ each independently represent a hydrogen atom or a monovalent linear or cyclic hydrocarbon group, and $R^e$ is a divalent hydrocarbon group.

Some illustrative, non-limiting examples of suitable dihydroxy compounds include dihydric phenols and the dihydroxy-substituted aromatic hydrocarbons such as those disclosed by name or formula (generic or specific) in U.S. Pat. No. 4,217,438. A nonexclusive list of specific examples of the types of bisphenol compounds that may be represented by formula (III) includes the following: 1,1-bis(4-hydroxyphenyl)methane; 1,1-bis(4-hydroxyphenyl)ethane; 2,2-bis(4-hydroxyphenyl)propane (hereinafter "bisphenol A" or "BPA"); 2,2-bis(4-hydroxyphenyl)butane; 2,2-bis(4-hydroxyphenyl)octane; 1,1-bis(4-hydroxyphenyl)propane; 1,1-bis(4-hydroxyphenyl) n-butane; bis(4-hydroxyphenyl) phenylmethane; 2,2-bis(4-hydroxy-1-methylphenyl)propane; 1,1-bis(4-hydroxy-t-butylphenyl)propane; bis(hydroxyaryl)alkanes such as 2,2-bis(4-hydroxy-3-bromophenyl)propane; 1,1-bis(4-hydroxyphenyl)cyclopentane; 4,4"-biphenol; and bis(hydroxyaryl)cycloalkanes such as 1,1-bis(4-hydroxyphenyl)cyclohexane; and the like as well as combinations comprising at least one of the foregoing bisphenol compound.

It is also possible to employ polycarbonates resulting from the polymerization of two or more different dihydric phenols or a copolymer of a dihydric phenol with a glycol or with a hydroxy- or acid-terminated polyester or with a dibasic acid or with a hydroxy acid or with an aliphatic diacid in the event a carbonate copolymer rather than a homopolymer is desired for use. Generally, useful aliphatic diacids have about 2 to about 40 carbons. A preferred aliphatic diacid is dodecandioic acid.

The polycarbonate component may also include various additives ordinarily incorporated in resin compositions of this type. Such additives are, for example, fillers or reinforcing agents; heat stabilizers; antioxidants; light stabilizers; plasticizers; antistatic agents; mold releasing agents; additional resins; and blowing agents. Combinations of any of the foregoing additives may be used. Such additives may be mixed at a suitable time during the mixing of the components for forming the composition.

The outer lens is usually produced by injection molding of a polycarbonate resin composition in a compounded form. The polycarbonate formulation is usually compounded in an extruder in order to provide appropriate mixing of the composition. Although the use of a single-screw extruder is conceivable, a twin-screw extruder is usually preferred to optimize the mixing and reduce the likelihood of creating scattering particles in the final product or simply avoid potential streaking issues that may stem from undissolved high-melting point colorants such as some perylene derivatives (melting point around 300° C.). Although the polycarbonate composition is generally light stabilized and the lens coated with a UV absorptive coating, it is important to use dyes that combine improved light fastness and heat stability. Good examples of fluorescent dyes with an improved light fastness and high heat stability are the perylene derivatives like the Lumogen Orange F-240, Lumogen Red F-300 and Lumogen Yellow F-083 supplied by BASF.

In order to better control the extremely low amount of dyes introduced in the formulation and therefore have a better color control of the lens, the use of volumetric or gravimetric feeders is highly recommended. The feeders can either feed a letdown of the concentrate in polycarbonate resin powder (preferably milled powder) or feed an already compounded (extruded) color masterbatch in a pellet form. The colorant loading in the letdown or the concentration of the masterbatches depends on the feeder capability, and especially the feeding rate. In general, powder letdown vary between 10:1 and 10,000:1 ratios of colorant (i.e. dye) to powder. Dye mixtures can also be used in a letdown form and fed from a single feeder although it is not the most preferred method. Poor color control may potentially result in lenses that would not be suitable for a headlamp application, i.e. beam color or light output not being compliant with the SAE standard.

One can produce lenses that specifically interact with light source to create colorful visual effect while reducing the discomfort glare. This can be obtained, for example, by using a lens containing a fluorescent dye in such manner that a part of the blue light responsible for the discomfort glare is shifted to higher wavelengths where the human eye has a lower spectral sensitivity. For example, the spectral characteristics of a yellow fluorescent dye like the BASF Lumogen Yellow F-083 or a red fluorescent dye like the Lumogen Red F-300 are such that they will shift the beam color towards the yellow or red respectively thus making the beam appear less "blue" and therefore more comfortable to look at for oncoming drivers. Other combinations of visual effect lenses with less common bulbs than halogen may provide customized aesthetic effect on vehicles but also customized lighting performance. An example would be to use a lens containing fluorescent dyes that absorb wavelengths outside the visible range (e.g. below 380 nm) and reemit in the visible, in combination with a UV rich light source (as for example a HID bulb). This would translate into an increase of the visible intensity of the beam compared to the emission from the natural lens and potentially allow for a reduction of the necessary voltage thus saving some battery power. Further, one can add non-photoluminescent dyes to the polycarbonate composition to further shift the chromaticity of the light source and produce a desired chromaticity of the illuminating headlamp beam.

Using this invention, one can produce a shift in beam chromaticity of the light source. One can select the composition of dyes (i.e., photoluminescent and non-photoluminescent) when determining which light source light source to use in order to produce an illuminating beam output of the lamp that is of legal color or of non legal color as determined by SAE requirements. It should be noted that most European countries, as well as countries like Japan, China, et al, do not require headlamps to be compliant with SAE requirements. Thus, this invention is not limited solely to SAE standards. It is a further embodiment of the present invention that the light source to be used is a high intensity halogen light source, namely a halogen infrared reflected bulb. It is a goal of this embodiment that the illuminating headlamp output provide an x chromaticity within the allowable bounds as suggest by SAE requirements.

FIG. 1 shows an embodiment of a lens for the headlamp in accordance with the invention. The lens has an outer surface 10, which has a generally convex curvature, and an opposing rear surface 11 which may be flat or concave. The overall thickness of the lens at its edge 12 is in the range of from 0.5 to 10 mm, for example 3.0 mm. The center portion of the lens may be thicker or thinner than the edge thickness, provided that structural integrity is maintained (the necessary thickness will depend to some extent on the other dimensions of the lens), and can be variable as the result of formation of rib lines 13 which are cut into the surface. Design features in the outer surface of the lens can be protrusions or depressions. V-shapes are usually preferred for depressions. Protrusions have preferably squared tops but round tops are also possible. The overall shape of the lens may be a rounded rectangle as shown, or it may be round or ovoid or any other appropriate shape for use with a particular lamp. For example, for some automotive headlamp applications, the lens may extend around the front corner of the vehicle, spanning parts of both the front and side surfaces of the vehicle.

The lenses of the present invention can be either affixed directly or indirectly to the headlamp housing. The present invention can also be translated to other applications than headlamps lenses such as lighting equipment where a synergistic combination of light source and a visual effect outer lens will offer new aesthetic solutions with comparable or improved lighting performance.

Figure 2:
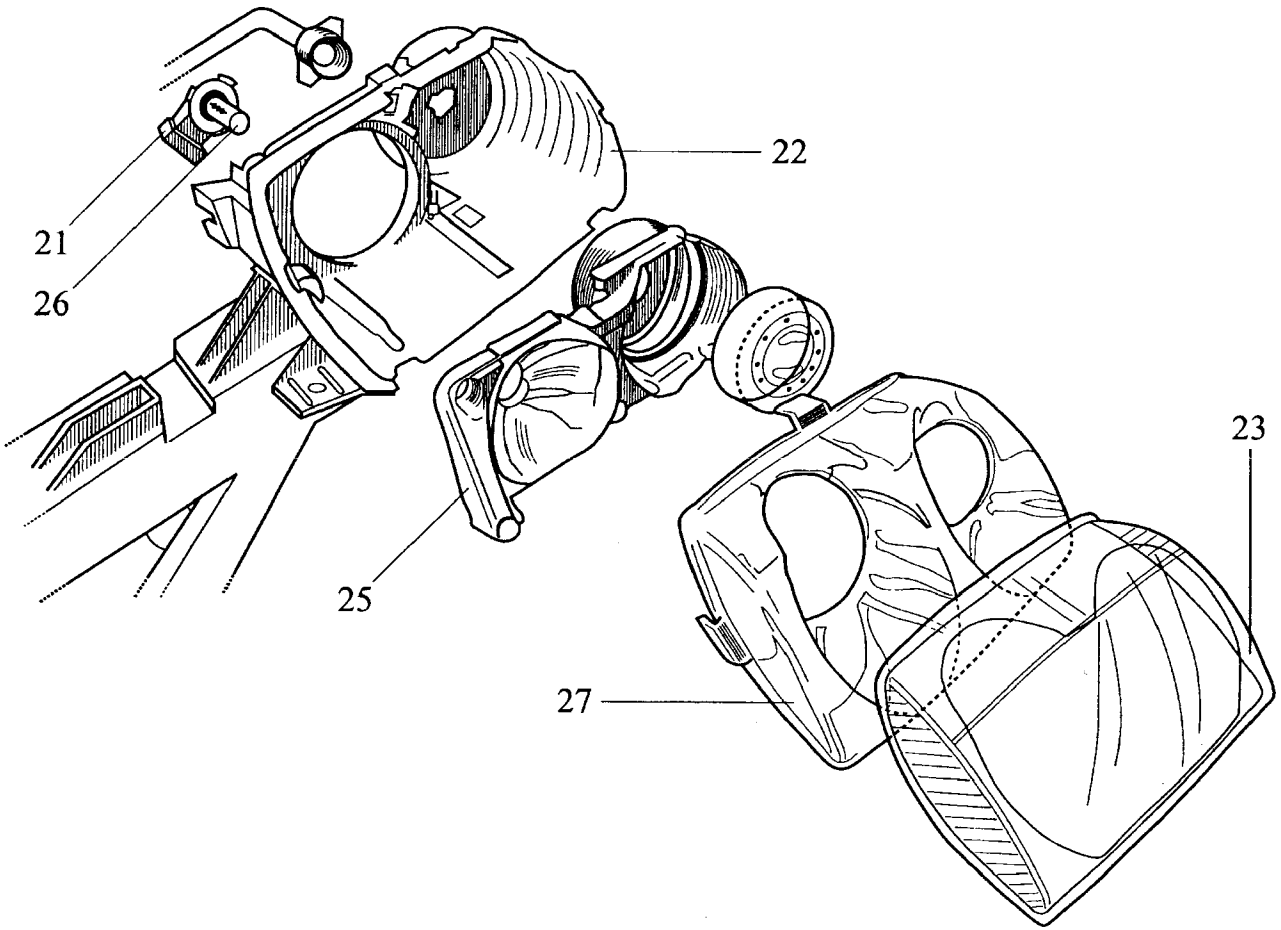
FIG. 2 shows an exploded view of an automotive headlamp.

The lenses of the invention may be treated with a surface coating to improve their utility in a specific application. For example, in the case of lenses for automotive headlamps, it is conventional to provide a surface coating of a UV absorber to extend the lifetime of otherwise UV-sensitive polycarbonate. Such UV-protective coatings may be made from acrylic or silicone-based polymers containing UV stabilizers, and are commonly applied by vapor deposition or chemical deposition. The coating is usually applied to the outer surface and edges, but may be applied to the entire exterior of the lens if desired. The lenses of the invention may also be used in other environments, for example to provide decorative effects in pool lighting. In this case, a chemically resistant coating would be used to protect the polycarbonate from degradation by pool chemicals. Alternatively, a chemically resistant polycarbonate formulation could be used. FIG. 2 shows an exploded view of a headlamp. The headlamp has a housing 22 which contains reflector assembly 25, a light source 26 and an electrical connector 21 for attachment to the electrical system of a vehicle. A bezel 27 and a lens 23 are disposed on the exterior of the housing such that light leaving the housing passes through the bezel and the lens. Either or both of the bezel 27 and the lens 23 can be made from polycarbonate including an photoluminescent material in accordance with the invention. When the bezel and the lens 23 includes an organic fluorescent dye, the dye may be the same or it may be different to provide a two-color effect. It will be appreciated that FIG. 2 shows one specific headlamp design and that numerous alternatives to the actual shape and structure exist. For example, the bezel may be omitted, and the housing and reflector may be a single component.

Figure 3:
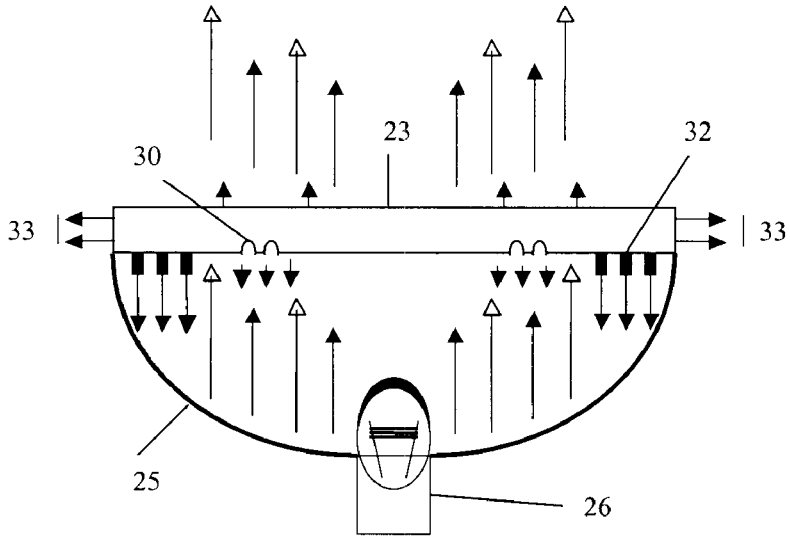
FIG. 3 shows a schematic of a headlamp where design characteristics in the lens such as grooves and protrusions redirect a part of the emission from the photoluminescent material toward the reflector assembly.

While substantial improvement in beam chromaticity can be obtained by simply passing light through the lens, it is possible to further improve the beam chromaticity by actively redirecting some or all of the light emitted by the photoluminescent material in the direction of the light source beam pattern. Thus another embodiment of the present invention is to provide a lens that does such. For instance, grooves or protrusions and other design features of the lens, such as lens edge reflectors, can be incorporated in such a manner that they redirect light emitted from the photoluminescence toward the reflector assembly instead of within the lens. FIG. 3 shows ray diagram and schematic of a headlamp in accordance with a preferred embodiment of the invention. The headlamp encompasses design characteristics disposed on the rear surface of the lens 23 such as grooves 30 and protrusions 32 which allow light emitted by the photoluminescent material to escape the lens towards the reflector assembly 25. The reflector assembly 25 then reflects the light that is emitted by the photoluminescent material and allowed to escape the lens as if it were generated by the light source 26. This light generated by the photomuminescent material is usually of different average chromaticity than the light generated by the light source 26. Thus, the effect is to further shift the illuminating headlamp chromaticity.

Figure 4:
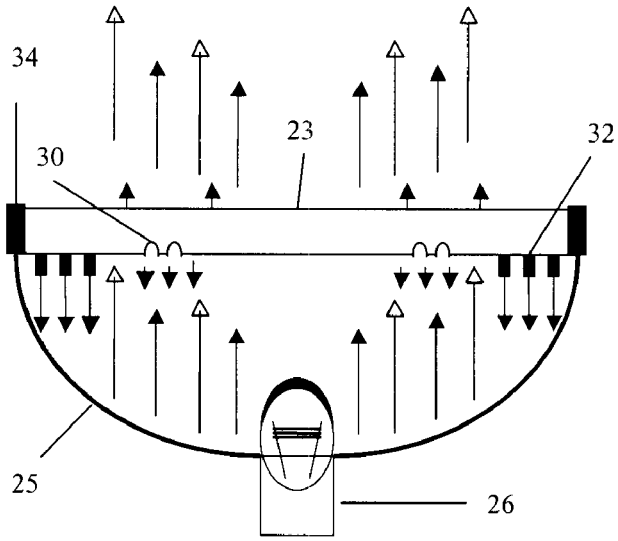
FIG. 4 shows schematic of a headlamp where a reflective layer reflects the light emitted towards the outer edge of the lens back into the lens.

FIGS. 3 and 4 show a light source 26, a reflector assembly 25 and a lens 23 among other things. Light generated by the light source 26 is portrayed with open ended arrows between the lens and the reflector assembly 25. Some of the light generated by the light source 26 strikes the lens 23 at such an angle as it passes through the lens to the outside of the headlamp. This is depicted by the open ended arrows in the illuminating beam 31. Light as it passes through the lens 23, may interact with the photoluminescent material contained with the lens 23. The photoluminescent material will then emit light that, depending on the direction relative to the lens surface will wither escape or will be conducted within the lens 23. Some of this light may be directed through the lens 23 to the outer portion of the lens 23 and produce a decorative edge effect 33 as portrayed in FIG. 3. Alternatively some of light emitted by the photoluminescent material will be allowed to escape the lens toward the reflector assembly 25 via protrusions 32 and grooves 30. The light that is allowed to escape the lens via the grooves 30 and the protrusions 32 is portrayed in FIGS. 3 and 4 as downward pointing dark ended arrows. The design features, namely grooves 30 and protrusions 32, are located on the inner surface of the lens 23. They create exit points for the light emitted by the photoluminescent material effect and thus may decrease the amount of light conducted within the lens 23. The light generated by the photoluminescence within the lens 23, which is allowed to escape the lens 23 is then combined with the output beam of the light source 26 by the reflector 25. This is portrayed in FIGS. 3 and 4 as upward pointing dark ended arrows in combination with the open ended arrows. This has the effect of further shifting the beam chromaticity light source 26 output beam since the light emitted by the photoluminescent material usually has a different average chromaticity than the output of the light source 26. Some of this reflected photoluminescent light then passes through the lens 23, and is incorporated with the illuminating beam 31 of the headlamp.

FIG. 4 displays yet another embodiment of the invention. In addition to the lens design features of FIG. 3, namely the protrusions 32 and grooves 30, FIG. 4 encompasses an edge reflector 34. The edge effect which is produced by light emitted from the photoluminescent material may be further redirected back into the lens 23 by the use of an edge reflector 34 on the lens. Thus in addition to FIG. 3, the headlamp of FIG. 4 encompasses further design characteristics in the lens 23 which are edge reflectors 34 which reflect at least part of the light that is conducted through the lens 23 that reaches the edge. FIG. 4 shows a simplified schematic of a headlamp where the light directed toward the outer edge is reflected back into the lens by edge reflectors 34. The edge reflector 34 is a reflective layer that is generally a coating based on white inorganic pigments such as $BaSO_4$, $TiO_2$, ZnO or micas. Metallic coatings (such as those based on aluminum, silver or other highly reflective metals or alloys are also possible. The edge reflector 24 can also be made of a thermoplastic material containing reflective pigments such as $TiO_2$, $BaSO_4$, ZnO, micas or metallic pigments (including aluminum, silver or other metals and alloys having sufficient reflectivity to form a reflective layer). The reflective layer needs to have at least 30% reflectivity, preferably 50% and more preferably 70%.

It should be noted that this embodiment of the invention does not require that the edge reflector 34 be present on all edges or the entire edge of the lens 23. The edge reflector 34 may only cover a portion of the edge or edges of the lens. Further the edge reflector 34 may cover all edges or the entire edge of the lens 23. Thus a decorative edge effect 33 effect may still be obtained even when incorporating the use of an edge reflector 34. Further, the methods displayed in FIGS. 3 and 4 to further improve beam chromaticity can be applied on a case-by-case basis depending on the type of light source used, the illuminating beam chromaticity desired and the amount of edge effect desired. For instance, the design features in automotive headlamps can be applied in such a manner that the overall beam photometry will still comply with the SAE J1383 and SAE J578 standards.

Light sources (or bulbs) can be classified in several categories: standard halogen, high intensity halogen (e.g., Halogen Infrared Reflected), high intensity gas discharge and solid state sources are among the classifications. The following section details such light sources and their technologies.

Standard Halogen Bulb

A halogen lamp includes a hermetically sealed, light transmissive envelope, and a tungsten filament within the envelope. A mixture is disposed within the envelope. The mixture includes inert gas, a halogen-containing compound, and a compound capable of gettering oxygen. When energized, light in the visible range of wavelengths is generated through the radiating tungsten filament within the envelope.

A halogen lamp has a tubular, light transmissive envelope formed from high temperature aluminosilicate glass, quartz, or other transparent material. A tungsten filament or coil is supported within the envelope by lead-in wires and formed from molybdenum, and which extend through a customary pinch seal. The lead-in wires may extend from opposite ends of the envelope, as in a double-ended lamp, or from the same end of the envelope as in a single-ended lamp. If desired, the molybdenum lead-in wires may be connected by means of welding, brazing, or other suitable means to less costly metals of similar or greater diameter to provide electrical connection for the filament and also support the lamp. The lead-in wires are electrically connected to a source of power, via base of the lamp for energizing the lamp.

For headlights, and other uses where it is desirable to modify the light output of the lamp, the lamp envelope may be coated on at least one of the its inner and outer surfaces with a coating of a filter material. The coating filters out a portion of the radiation from the filament from the light leaving the envelope. In the case of a "blue" lamp, such as for a headlight, the filter filters a portion of the red light and yellow light, giving a bluer appearance. Infrared filters and or UV filters may also be used. The lamp envelope may also be doped with filtering material.

High intensity halogen light source and Halogen Infrared Reflected (HIR) light source:

High intensity halogen light sources usually are double ended tungsten halogen IR lamps. Other tungsten halogen IR lamps may also be used, including single ended lamps. The lamp has a tubular, light transmissive envelope formed from high temperature aluminosilicate glass, quartz, or other transparent material. A tungsten filament or coil is supported within the envelope by lead-in wires and formed from molybdenum, and which extend through a customary seal. The lead-in wires may extend from opposite ends of the envelope, as in a double-ended lamp, or from the same end of the envelope as in a single-ended lamp. If desired, the molybdenum lead-in wires may be connected by means of welding, brazing, or other suitable means to less costly metals of similar or greater diameter to provide electrical connection for the filament and also support the lamp. The lead-in wires are electrically connected to a source of power (not shown), via base of the lamp for energizing the lamp.

A halogen infrared reflected (HIR) bulb is a tungsten filament halogen bulb with a special durable infrared reflective coating applied to the bulb capsule. The coating makes the bulb more efficient at producing light and focusing heat energy that would otherwise be lost back on the filament. Such a coating can be created through multilayer thin film technology that reflects IR wavelengths back toward the filament. This reflecting effect permits the filament to operate at a higher temperature while using less electrical energy.

High Intensity Gas Discharge (HID)

A high intensity gas discharge lamp includes a hermetically sealed, light transmissive envelope, and tungsten electrodes within the envelope. A mixture is disposed within the envelope. The mixture includes inert gas, noble gas, metallic salts, among them rare earth salts, and may also include mercury and halogen-containing compound. When energized, light in the visible range of wavelengths is generated through a radiating body of gas within the envelope. Other gas discharge lamps may also be used.

A high intensity gas discharge lamp has tubular, light transmissive envelope formed from high temperature aluminosilicate glass, quartz, ceramic, or other transparent material. Tungsten electrodes are supported within the envelope by lead-in wires formed from molybdenum, and which extend through a customary seal. If desired, the molybdenum lead-in wires may be connected by means of welding, brazing, or other suitable means to less costly metals of similar or greater diameter to provide electrical connection for the filament and also support the lamp. The lead-in wires are electrically connected to a source of power, via base of the lamp for energizing the lamp. A UV blocking shroud formed from high temperature aluminosilicate glass, or other UV blocking transparent material may be installed around the arc tube.

For headlights, and other uses where it is desirable to modify the light output of the lamp, the lamp shroud may be coated on at least one of its inner and outer surfaces with a coating of a filter material. The coating filters out a portion of the radiation from the filament from the light leaving the envelope. The lamp envelope and/or shroud may also be doped with filtering material.

Solid State Light Source

A Light Emitting Diode (LED) is an indivisible discrete light source unit, containing (a) semiconductor n-p junction(s), in which visible light is produced when forward current flows as a result of applied voltage. Other Solid State Light Sources may be used as well.

The invention will now be further described with reference to the following, non-limiting examples.

EXAMPLE 1

Polycarbonate formulations (B) to (E) shown below in Table 1 (unit: parts per weight) have been designed to illustrate the ability to create a broad palette of light transmission characteristics for the present invention. A twin-screw extruder has been used for the compounding step with standard Lexan® LS-2 polycarbonate extrusion conditions. A standard polycarbonate product (LEXAN® LS2-111) used in automotive lighting and especially automotive headlamps was selected as a comparison. Plaques with a high gloss finish (dimensions: 10.16 cm×7.62 cm×3.0 mm) were molded for each formulation according to the standard processing conditions defined for the material in the technical datasheet.

The low flow PC resin used is poly(bisphenol-A carbonate) with an average molecular weight ($M_W$) of 29,900 (All molecular weights of PC in the application are determined by GPC, i.e. Gel Permeation Chromatography, against absolute polycarbonate standards. The high flow PC resin used is a poly(bisphenol-A carbonate) with an average molecular weight ($M_W$) of 21,900. The heat stabilizer is tris(2,4-di-tert-butylphenyl)phosphite. The mold release agent is pentaerythritol tetrastearate. The UV stabilizer is 2-(2H-benzotriazol-2-yl)-4-(1,1,3,3-tetramethylbutyl)phenol. Pigment Blue 60 was obtained from BASF (BASF Heliogen Blue K6330). Solvent Violet 36 was obtained from Bayer (Bayer Macrolex Violet 3R). OB-184 (i.e. 2,5-bis(5'-tert-butyl-2-benzoxazolyl)thiophene) was obtained from Ciba (Ciba Uvitex OB).

Color coordinates were measured on the chips in transmission mode using a Gretag MacBeth 7000A spectrophotometer selecting illuminant C and a 2° observer. The instrument was calibrated in accordance with the manufacturer specifications using a white calibration tile. A large viewing area and large aperture were used for the measurements. Other settings included Specular Component Included (SCI) and UV partially included (calibrated for UVD65 with a UV tile). The MacBeth Optiview 5.2 software recorded the data and calculated the CIE 1931 (Yxy) color coordinates for an illuminant C and a 2° observer. The CIE 1931 (Yxy) color coordinates are summarized in Table 2.

As Y corresponds to the light transmission of the plaque at 3.0 mm, the results confirm that materials B to E cover a broad range of light transmission within the preferred range for this invention. In addition, it must be noted that the x chromaticity value decreases incrementally going from A to E. This significant shift illustrates a progressive shift from clear (A) toward the bluest formulation (E). It should be mentioned that the strongest blue shift has been obtained with a relatively low colorant loading: less than about 0.004% of non-fluorescent colorant and about 0.05% of organic photoluminescent dye.

EXAMPLE 2

In order to test feasibility of the colored lens application for road use in a motor vehicle, an automotive headlamp in accordance with this invention was tested for beam color and photometry. As explained previously in the specifications, all automotive headlamps installed by car manufacturers need to produce an acceptable beam pattern and meet headlamp color regulations.

A headlamp from a quad headlamp system, with lower beam designed around the HB4 (ANSI 9006) was selected because of the possibility to also apply the optics system to a high lumen HIR2 (ANSI 9012) light source. The HB4 and HIR2 have identical light center length and overlapping coil boxes, which would make the sources optically interchangeable from a filament imaging perspective. Because of the higher lumen output it is not a priori expected that the headlamp with HIR2 source will pass beam pattern regulations, but the resulting beam pattern is expected to be a match in first order approximation.

The headlamp was of the reflector optics type, and had been assembled without the standard clear lens. A control lens and two lens preparations with the different resin formulations, giving lenses A through C (see Table 2) were used. These 3 lenses were used for photometry and color measurements of both headlamps.

The measurement set-up consisted of a LMT GO-H 1200 goniophotometer with inline photometer head at 18.29 m. An auxiliary LMT C 1200 tristimulus colorimeter connected to a CH-60 precision colorimeter head could be mounted in line with the photometer head at distance 3.05 m from the bulb center.

Beam intensity and beam color in each of the points specified in the US headlamp regulations (49CFR571.108) for the low beam of the headlamp was measured with both sources and each of the 3 lenses, with the exception that the 10 U–90 U region was excluded for the color measurement.

A typical run for a given lens prescription would exist of two parts. First the beam photometry would be read starting with the lamp in the position aimed for the photometer head. Bulbs were energized at 12.8V. After completion of the beam photometry with the lamp ending in its starting position, the auxiliary tristimulus calorimeter would be mounted its place 3.05 m from the headlamp center and the beam color would be read with the lamp starting in its original aim position, using the same program used for the beam photometry.

Sphere photometry data at 12.8V:

Automotive outer lenses were molded from polycarbonate formulations (A) to (E). In addition, a blue edge glow effect is also visible adding the benefits of an aesthetic effect to the improved lighting performance.

The results of the isocandela measurement (integrated headlamp lumens), and average beam chromaticity (x, y) from the beam photometry testing are summarized in Table 4 for the HIR2 and HB4 sources and lens material A to E. As expected, the beam intensity—as illustrated by the integrated lumens —decreases as a function of the light transmission of the lens. With both sources, going from the clear lens to lens material C, a significant beam color shifted can be measured as illustrated by the shift in the x chromaticity value. This clearly indicates that the beam color is shifted towards the blue region of the SAE J578 "white light". The bluest beam measured was obtained by combining in the headlamp the HIR2 bulb with the lens molded from material E. However, it must be noted that the beam color resulting from the combination of HIR2 bulb and lens C ends up very close to the edge of the ECE Regulation 99 HID specification, which suggests that it could meet the exact HID color space if design features were added to the lens. As a reference, the chromaticity of a commercial HID bulb (Philips D2S bulb) has been plotted on the CIE1931 diagram (x=0.38+/−0.025 and y=0.39+/−0.015). From Table 4, we can conclude that the following combinations are preferred for the lens/headlamp design used for the experiment:

The headlamp equipped with a HIR2 source and a lens molded from material D will have a total illuminating light output of about 507 lumens (integrated lumens) and a chromaticity value x of about 0.3966 and y of about 0.3962.

The headlamp equipped with a HIR2 source and a lens molded from material E will have a total illuminating light output of about 453 lumens (integrated lumens) and a chromaticity value x of about 0.3851 and y of about 0.3925.

It is noteworthy that the combinations referred above fall within the ECE Regulation 99 HID specifications and also within the published specifications for one of the most standard HID bulb (Philips D2S). In addition, the headlamp equipped with lens material E will have a chromaticity extremely close to the example of HID bulb thus confirming the good color match. Furthermore, the light output of a headlamp with this lens is predicted to be about 10% higher than a standard HB4 (ANSI 9006) equipped with a clear lens (A). This result demonstrates that using this invention, it is possible to produce headlamps capable of emitting a light beam that matches the chromaticity of an HID headlamp while providing improved light output compared to a standard halogen system such as the combination HB4/clear lens. It must be noted also that blue halogen bulbs (such as the Silverstar® bulb) emit only about 1000 lumens when powered at 12.8 Volts according to their specification, which is similar to the HB4. As a result, such bulbs are not expected to yield better total illuminating light output (integrated lumens) than the combination HB4/clear lens and should therefore under perform the headlamps of this invention.

EXAMPLE 3

Polycarbonate formulation (F) (Note: This is the same as formulation (D) in the results section of U.S. patent application Ser. No. 10/063,791 filed May 13, 2002) described below has been defined to illustrate the ability to create a broad palette of visual effect color for outer lenses. A twin-screw extruder has been used for the compounding step with standard Lexan® LS-2 polycarbonate extrusion conditions. Color chips (5.08 cm×7.62 cm×3.2 mm) were molded for each formulation and color coordinates were measured on the chips in transmission mode using a MacBeth 7000A spectrophotometer selecting illuminant C and a 2 degree observer.

A polycarbonate resin composition (F) was prepared by mixing: −65 parts of poly(bisphenol-A carbonate) with an average molecular weight ($M_W$) of 29,900 −35 parts of poly(bisphenol-A carbonate) with an average molecular weight ($M_W$) of 21,900 −0.06 parts of tris(2,4-di-tert-butylphenyl)phosphite −0.27 parts of pentaerythritol tetrastearate −0.27 parts of 2-(2H-benzotriazol-2-yl)-4-(1,1,3,3-tetramethylbutyl)phenol −0.05 parts of 2,5-bis(5'-tert-butyl-2-benzoxazolyl)thiophene (Ciba Uvitex OB)-0.0001 parts of C.I. Pigment Blue 60 (BASF Heliogen Blue K6330)-0.00005 parts of C.I. Solvent Violet 36 (Bayer Macrolex Violet 3R).

It should be noted that lens (F) has more design features (i.e. protrusions, grooves and cuts) compared to the lenses molded in Example 2. When equipped with a HB4 (ANSI 9006) light source, it was apparent that the headlamp beam color was shifted towards a whiter/bluer beam color. In addition, a colored visual effect was observed from the accent features of the lens (protrusions, grooves and cuts).

Automotive outer lenses were molded from polycarbonate formulations (F). When the lenses were incorporated in automotive headlamps, it was apparent that the headlamp beam color was white while a strongly colored visual effect was observed that shines from design features of the lens (protrusions, lines and edges).

A lens molded from formulation (F) was combined with a halogen bulb to test SAE conformity in a headlamp configuration. Natural color Lexan® LS-2 resin was used as a reference in order to evaluate the lighting performance according to SAE J1383. The results of the isocandela testing (total flux), maximum candela (point intensity) and beam chromaticity (x,y) are summarized in Table 5. It is noteworthy that both the maximum candela and the isocandela confirm that the visual effect lenses combined to the halogen bulb give a comparable light output in terms of intensity which is within +/−5% of the reference (natural color). Moreover, headlamp with the blue lens made from formulation (F) displays a much bluer (i.e. whiter) beam compared to the reference as the CIE 1931x chromaticity value is shifted from 0.4424 to 0.4040. This result is also confirmed by the visual evaluation of the beam color.

This result compared to example 2 shows the effect of the design features in a lens. In addition, it shows that it is possible to create headlamps that meet the SAE standards and have a beam chromaticity value x of less than 0.405 even when a very low amount of non-fluorescent dye loading of about 0.00015% is used in combination with an organic photoluminescent dye.

In case of light sources with an average x chromaticity of greater than 0.405, which is the case of most halogen bulbs, HIR bulbs, some solid state sources and very few HID lamps, typically, lens compositions (D) and (E) of example 2 will be the preferred compositions. This is because they provide the most significant color shift even with a lens that has limited or no design features, such as grooves or protrusions to further shift the beam. When the lens has design features such as grooves and protrusions as illustrated in FIGS. 3 and 4, less non-fluorescent dye loading is required (even 0.00015% coupled to a fluorescent dye loading of 0.05% produces the desired results). Further, even a small dye loading as mentioned in lens composition F of example 3 would be acceptable with appropriate design features such as protrusion or grooves. Thus, a ratio of fluorescent dyes/non-fluorescent dyes of about 330 (composition F, example 3) can produce the desired chromaticity. However, the preferred dye compositions in connection with limited or no design features in the lens correspond to ratios of about 19 (composition D, example 2) and 13 (composition E, example 2). In any case, the preferred fluorescent dye loading is from 0.005% to 0.5%, with 0.01% to 0.25% being more preferred.

In the case of light sources with an average×chromaticity of less then 0.405, namely white solid state light sources and good HID sources, formulations (B) and (C) are preferred over (D) and (E) of example 2. This is because formulations (B) and (C) reduce the risk of shifting the beam outside the SAE "white box"as defined above. The preferred non-fluorescent to fluorescent dye ratio will be >20. Preferred fluorescent dye loading will be less than or equal to 0.1%

The invention claimed is:

1. An automotive headlamp comprising:

a housing for receiving a light source;

a light source received in the housing;

an outer lens affixed to the housing and disposed such that light from the light source received in the housing passes through the lens;

wherein the lens comprises a polycarbonate and a photoluminescent material; and wherein the light source and the material of the lens are selected such that light emitted from the light source is modified in chromaticity as it passes through the lens such that the illuminating beam from the headlamp has an average x chromaticity coordinate of 0.345 to 0.405 and has chromaticity coordinates inside the following boundaries as defined by the CIE 1931 color model and measured using spectrophotometric methods as presented in the ASTM standard E 308-66:

a blue boundary of X=0.31 a yellow boundary of X=0.50
a green boundary of Y=0.15+0.64x
a purple boundary of Y=0.05+0.75x
a green boundary of Y=0.44
and a red boundary of Y=0.38.

2. The headlamp of claim 1, wherein the photoluminescent material comprises an organic fluorescent dye.

3. The headlamp of claim 2, wherein the lens material further comprises a non-fluorescent dye.

4. The headlamp of claim 3, wherein the fluorescent dye is included at a concentration of 0.0001 to 1 weight % of fluorescent dye and the non-fluorescent dye is included at a concentration of 0.00001 to 0.1 weight % of non-fluorescent dye.

5. The headlamp of claim 3, wherein the fluorescent dye is included at a concentration of 0.005 to 0.5 weight % of fluorescent dye and the non-fluorescent dye is included at a concentration of 0.0001 to 0.01 weight % of non-fluorescent dye.

6. The headlamp of claim 2, wherein the fluorescent dye is selected from the group consisting of perylenes, anthracenes, benzoxazoles, stilbenes, indigoids and thioindigoids, irnidazoles, naphtalirnides, xanthenes, thioxanthenes, coumarins, rhodarnines, and (2,5 -bis[5-tert-butyl-2-benzoxazolyl]thiophene).

7. The headlamp of claim 1, wherein the light source is selected from the group consisting of:
a high intensity gas discharge light source,
a solid state light source,
a standard halogen light source, and
a halogen infrared reflected light source.

8. The headlamp of claim 7, wherein the light source has an average x chromaticity coordinate of greater than 0.405.

9. The headlamp of claim 7, wherein the photoluminescent material comprises an organic fluorescent dye.

10. The headlamp of claim 9, wherein the lens material further comprises a non-fluorescent dye.

11. The headlamp of claim 10, wherein the fluorescent dye is included at a concentration of 0.0001 to 1 weight % of fluorescent dye and the non-fluorescent dye is included at a concentration of 0.00001 to 0.1 weight % of non-fluorescent dye.

12. The headlamp of claim 10, wherein the fluorescent dye is included at a concentration of 0.005 to 0.5 weight % of fluorescent dye and the non-fluorescent dye is included at a concentration of 0.0001 to 0.01 weight % of non-fluorescent dye.

13. The headlamp of claim 12, wherein the light source has an average x chromaticity coordinate of greater than 0.405.

14. The headlamp of claim 10, wherein the fluorescent dye is included at a concentration of 0.01 to 0.25 weight % of fluorescent dye and the non-fluorescent dye is included at a concentration of 0.001 to 0.01 weight of non-fluorescent dye.

15. The headlamp of claim 14, wherein the light source has an average x chromaticity coordinate of greater than 0.405.

16. The headlamp of claim 9, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodarnines, and (2,5-bis[5-tert-butyl-2-benzoxazolyl]thiophene).

17. The headlamp of claim 7,
wherein the light source is a halogen infrared reflected light source;
wherein the light source has a low beam output and an high beam output;
wherein the low beam output is greater than or equal to 980 lumens and the high beam output is greater than or equal to 1180 lumens;
wherein the headlamp has a low illuminating beam output and a high illuminating beam output; and
wherein the low illuminating beam output is greater than or equal to 43(1 lumens and the high illuminating beam output is greater than or equal to 680 lumens.

18. The headlamp of claim 17,
wherein the low beam output is greater than or equal to 1280 lumens and the high beam output is greater than 1500 lumens; and
wherein the low illuminating beam output is greater than or equal to 480 lumens and the high illuminating beam output is greater than or equal to 730 lumens.

19. The headlamp of claim 17,
wherein the low beam output is greater than or equal to 1480 lumens and the high beam output is greater than or equal to 1680 lumens; and
wherein the low illuminating beam output is greater than or equal to 530 lumens and the high illuminating beam output is greater than or equal to 780 lumens.

20. The headlamp of claim 17, wherein the photoluminescent material comprises an organic fluorescent dye.

21. The headlamp of claim 20, wherein the lens material further comprises a non-fluorescent dye.

22. The headlamp of claim 21, wherein the fluorescent dye is included at a concentration of 0.0001 to 1 weight % of fluorescent dye and the non-fluorescent dye is included at a concentration of 0.00001 to 0.1 weight % of non-fluorescent dye.

23. The headlamp of claim 21, wherein the fluorescent dye is included at a concentration of 0.005 to 0.5 weight % of fluorescent dye and the non-fluorescent dye is included at a concentration of 0.0001 to 0.01 weight % of non-fluorescent dye.

24. The headlamp of claim 21, wherein the fluorescent dye is included at a concentration of 0.01 to 0.25 weight % of fluorescent dye and the non-fluorescent dye is included at a concentration of 0.001 to 0.01 weight % of non-fluorescent dye.

25. The headlamp of claim 20, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodamines, and (2,5-bis[5-tert-buty1-2-benzoxazoly]thiophene).

26. The headlamp of claim 1, wherein the lens has grooves or protrusions formed on a major surface thereof, the major surface facing inwards toward the light source and the housing.

27. The headlamp of claim 26, wherein the lens has an edge and an edge reflector, wherein the edge reflector covers at least a portion of the edge, whereby light conducted within the lens that reaches the edge and is reflected back into the lens.

28. The headlamp of claim 27, wherein the photoluminescent material comprises an organic fluorescent dye.

29. The headlamp of claim 28, wherein the lens material further comprises a non-fluorescent dye.

30. The headlamp of claim 29, wherein the fluorescent dye is included at a concentration of 0.0001 to 1 weight % of fluorescent dye and the non-fluorescent dye is included at a concentration of 0.00001 to 0.1 weight % of non-fluorescent dye.

31. The headlamp of claim 29, wherein the fluorescent dye is included at a concentration of 0.005 to 0.5 weight % of fluorescent dye and the non-fluorescent dye is included at a concentration of 0.0001 to 0.01 weight % of non-fluorescent dye.

32. The headlamp of claim 29, wherein the fluorescent dye is included at a concentration of 0.01 and 0.25 weight % of fluorescent dye and the non-fluorescent dye is included at a concentration of 0.001 and 0.01 weight % of non-fluorescent dye.

33. The headlamp of claim 29, wherein the fluorescent dye produces a visual effect at an edge of the lens.

34. The headlamp of claim 28, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodamines, and (2,5-bis[5-tert-butyl-2-benzoxazolyl]thiophene).

35. The headlamp of claim 1, wherein an exterior surface of the lens is coated with a UV-coating.

36. The headlamp of claim 35, wherein the photoluminescent material comprises an organic fluorescent dye.

37. The headlamp of claim 36, wherein the lens material further comprises a non-fluorescent dye.

38. The head lamp of claim 37, wherein the fluorescent dye is included at a concentration of 0.0001 to 1 weight % of fluorescent dye and the non-fluorescent dye is included at a concentration of 0.00001 to 0.1 weight % of non-fluorescent dye.

39. The head lamp of claim 37, wherein the fluorescent dye is included at a concentration of 0.005 to 0.5 weight % of fluorescent dye and the non-fluorescent dye is included at a concentration of 0.0001 to 0.01 weight % of non-fluorescent dye.

40. The headlamp of claim 36, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodamines, and (2,5-bis[5-tert-butyl-2-benzoxazolyl]thiophene).

41. The headlamp of claim 2, wherein the fluorescent dye has a quantum yield of 0.7 or greater.

42. The headlamp of claim 38, wherein the fluorescent dye has a quantum yield of 0.9 or greater.

43. A method for altering chromaticity of an automotive headlamp comprising the steps of, selecting a partial headlamp assembly comprising a light source and a housing, wherein the light source has a first chromaticity;

selecting a lens comprising a polycarbonate and a fluorescent dye; and affixing the lens to the partial headlamp assembly thereby forming a headlamp assembly, such that light emitted from the light source passes through the lens to form an illuminating beam, wherein the composition of the lens is selected to modify the first chromaticity such that the illuminating beam has a second chromaticity that is different from the first chromaticity, and said second chromaticity has an average x chromaticity coordinate of 0.345 to 0.405 and has chromaticity coordinates inside the following boundaries as defined by the CIE 1931 color model and measured using spectrophotometric methods as presented in the ASTM standard E 308-66:

a blue boundary of X=0.31 a yellow boundary of X=0.50 a green boundary of Y=0.15 +0.64x a purple boundary of Y=0.05 +0.75x a green boundary of Y=0.44 and a red boundary of Y=0.38.

44. The method of claim 43 wherein the light source has an average x chromaticity coordinate greater than 0.405.

* * * * *

UNITED STATES PATENT AND TRADEMARK OFFICE

CERTIFICATE OF CORRECTION

PATENT NO. : 7,168,833 B2
APPLICATION NO. : 10/605511
DATED : January 30, 2007
INVENTOR(S) : Schottland et al.

It is certified that error appears in the above-identified patent and that said Letters Patent is hereby corrected as shown below:

Col. 17 Claim 6 should read: --The headlamp of claim 2, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodamines, and (2,5-bis[5-tert-butyl-2-benzoxazolyl]thiophene).--

Col. 17 Claim 14, Line 54 should read: --a concentration of 0.001 to 0.01 weight % of non-fluorescent--

Col. 17 Claim 16 should read: --The headlamp of claim 9, wherein the fluorescent dye is selected from the group consisting of perylenes, anthracenes, benzoxazoles, stilbenes, indigoids and thioindigoids, imidazoles, naphtalimides, xanthenes, thioxanthenes, coumarins, rhodamines, and (2,5-bis[5-tert-butyl-2-benzoxazolyl]thiophene).--

Claim 17, Line 9 should read: --or equal to 430 lumens and the high illuminating beam--

Col. 18 Claim 25, Line 49 should read: --benzoxazolyl]thiophene).--

Signed and Sealed this

Twenty-second Day of May, 2007

JON W. DUDAS
*Director of the United States Patent and Trademark Office*